United States Patent [19]

Weiner

[11] Patent Number: 4,910,814

[45] Date of Patent: Mar. 27, 1990

[54] SPLASH POOL FOR RECREATIONAL WATER SLIDES

[76] Inventor: Robert I. Weiner, 305 W. Chesapeake Ave., Towson, Md. 21520

[21] Appl. No.: 122,919

[22] Filed: Nov. 19, 1987

[51] Int. Cl.[4] ..... E04H 3/18

[52] U.S. Cl. ..... 4/488; 4/494; 4/495; 4/496; 4/504; 272/1 B; 272/26; 272/56.5 R

[58] Field of Search ..... 4/495, 488, 487, 496, 4/501, 504; 272/56.5, 1 B, 26

[56] References Cited

U.S. PATENT DOCUMENTS

| | | | |
|---|---|---|---|
| 2,825,910 | 3/1958 | Prudek | 4/495 |
| 3,046,566 | 7/1962 | Berman | 4/495 |
| 3,092,844 | 6/1963 | Brunson | 4/495 |
| 3,813,703 | 6/1974 | Beaudin, Jr. | 4/494 |
| 3,874,005 | 4/1975 | Badon | 4/495 |

*Primary Examiner*—Henry K. Artis

*Attorney, Agent, or Firm*—Peter L. Klempay

[57] ABSTRACT

The splash or landing pool of a water slide has an entry zone of substantially increased depth relative to conventional splash pools and a shallow exit zone leading from the entry zone. The entry zone is provided with a false floor at a depth such that a child can walk thereacross, the false floor being a close mesh net which can safely decelerate an adult who has improperly entered the pool from the slide.

9 Claims, 3 Drawing Sheets

SPLASH POOL FOR RECREATIONAL WATER SLIDES

The present invention pertains to recreational water slides and, more particularly, to improvements in the splash pools of such slides.

BACKGROUND OF THE INVENTION

Recreational water slides are inclined chutes or flumes lubricated with a flowing water film and which descend from an elevated entry zone along either a straight path (a speed slide) or a meandering path (a serpentine slide) to an exit section which may empty into a splash pool. While the exit section of the slide may include a substantially level run out section to decelerate the rider before the end of the slide, the momentum of the rider may still be substantial at the time of entry into the splash pool, the purpose of which is to safely bring the rider to a stop. As a large proportion of the users of water slides are children, the typical splash pool is of shallow construction, having a maximum water depth of 3½ to 4 feet, to allow the rider to stand and walk from the pool. When an adult rides the slide, such a shallow pool is adequate and safe if the adult rider exits with the proper posture, that is, a forwardly facing seated position with the legs straight and slightly elevated. It will be apparent that the greater momentum of an adult will carry such a rider further into the water than a child and that, accordingly, there is a substantial risk of injury. If, for example, an adult enters the splash pool with a leg in a bent down position, the foot may strike the pool bottom with a force sufficient to cause injury to the bones and joints. If an adult rides the slide in a head first position, in violation of the rules imposed by many slide operators, the adult's head may hit the pool bottom if the slider drops his head and arms at water entry, causing head and/or spinal injuries. Increasing the size or depth of the pool is not an adequate solution as, while such an alteration does provide additional protection for adult users, the increased depth represents a hazard for young users.

It is the primary object of the present invention to provide a water slide splash pool which provides a substantial degree of protection for an adult user even in the event of improper use of the slide while maintaining the usual safety features for children using the slide.

It is a further object of the present invention to provide such a water slide splash pool which is configured so as to permit children and adults who have entered the pool from the slide to stand in and walk from the pool.

Another object of the present invention is the provision of such a water slide splash pool which is easily maintained in a clean and sanitary condition.

SUMMARY OF THE INVENTION

The above and other objects of the invention which will become apparent hereinafter are achieved by the provision of a splash pool adjacent the exit of a water slide which pool includes a first region in the vicinity of the slide exit of a depth greater than that of conventional splash pools, being, for example, 6 feet; a second relatively shallow and upsloping exit region extending from the first region in a direction away from the slide exit; and a false floor in the first region at a depth of 3½ or 4 feet which is sufficiently resilient as to cushion an adult entering the pool from the slide while providing a supporting surface for a smaller individual. Preferably, the false floor is formed of a small mesh net material releasably anchored to the side walls of the first region of the pool.

For a more complete understanding of the invention and the objects and advantages thereof reference should be had to the following detailed description and the accompanying drawings wherein a preferred embodiment of the invention is described and illustrated.

DESCRIPTION OF THE PREFERRED EMBODIMENT

Figure 1:
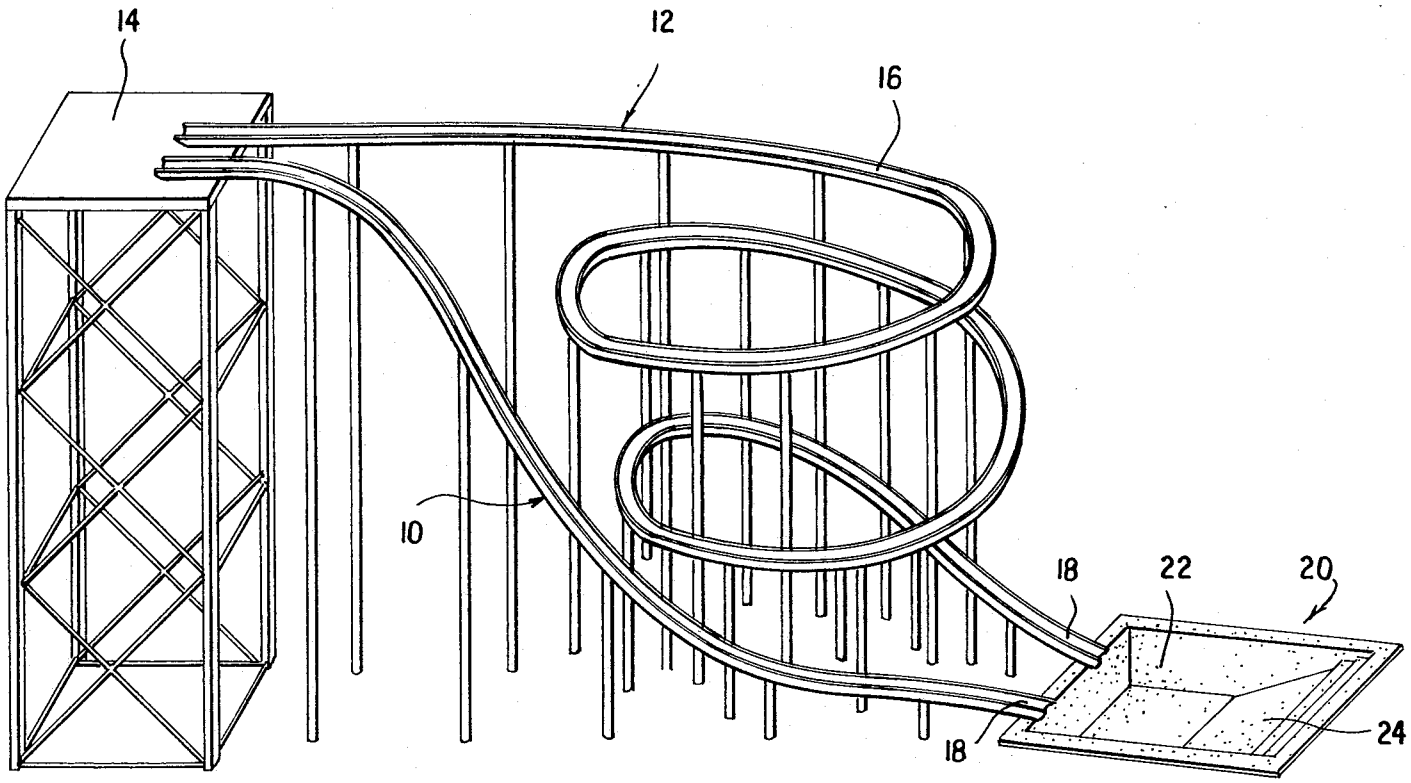
FIG. 1 is a perspective view of a water slide installation.
Figure 2:
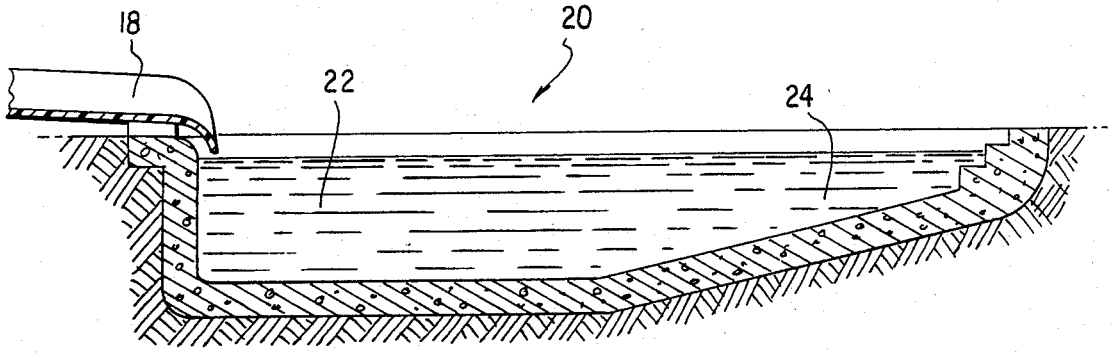
FIG. 2 (PRIOR ART)
FIG. 2 is a cross sectional view of a conventional or prior art splash pool.

The water slide installation depicted in FIG. 1 includes two slides, a speed slide 10 and a serpentine slide 12. Each of these slides begins at an elevated entry zone 14 and consists of a flume or chute 16 which descends either in a straight path in the case of a speed slide or in a meandering or curved path in the case of a serpentine slide, the slide being lubricated by a film of water flowing downwardly from the slide entrance. The lower end 18 of the chute is substantially horizontal thus providing a run out section to partially decelerate the rider, this section may be of substantial length in a speed slide. With either type of slide, the run out section 18 often leads to a splash or landing pool 20. The typical splash pool of the prior art, as shown in FIG. 2, has an entry zone 22 having a water depth in the range of 3½to 4 feet and, on the side of the pool opposite the run out section, an exit zone 24 provided with an upwardly sloping bottom wall to permit the rider to walk out of the pool.

When a rider descends the slide properly, that is, forwardly facing in a seated position with the legs straight and raised slightly, the conventional splash pool safely brings even an adult rider to a safe stop. The relatively shallow depth of the pool allows even young riders to stand and walk from the pool after being stopped, the rider not being required to swim. While water slide operators normally prohibit riding the slide in other than the proper seated position, individuals will attempt to do so. Such activities present substantial risks of injury, particularly for adult riders. As was mentioned above, descending in a head first position may result in head or spinal injury if the head strikes the pool bottom. Likewise, failure to maintain the legs straight and slightly elevated while entering the pool can lead to injuries to the leg bones and joints or loss of control of the body causing tumbling and contact with the pool walls or bottom. Increasing the size and depth of the pool would serve to provide additional protection against such injuries but would prevent the smaller riders from being able to exit the pool without swimming and would be a danger to non-swimmers. As the majority of the users of water slides are children and many are non-swimmers, such a solution is not practical.

Figure 3:
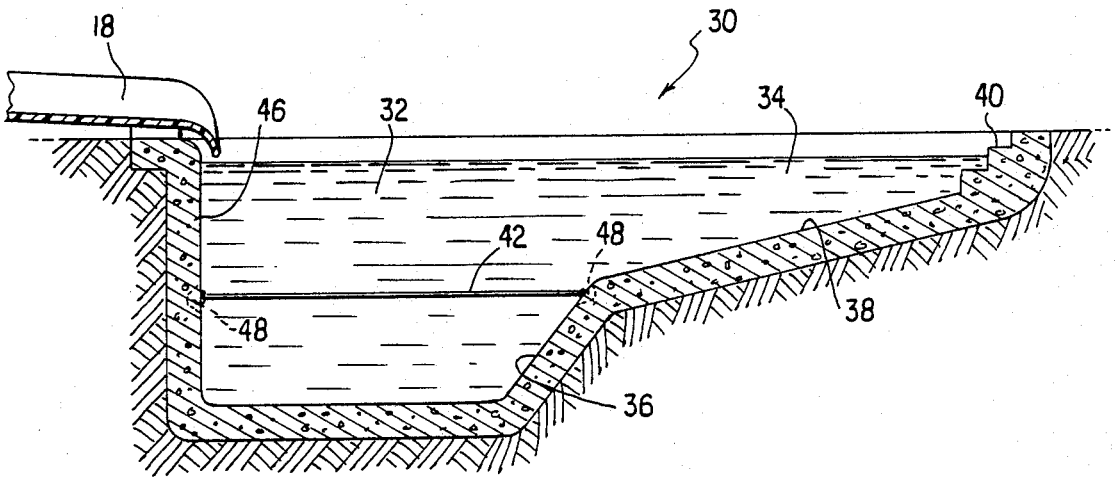
FIG. 3 is a cross sectional view of the splash pool of the present invention.
Figure 4:
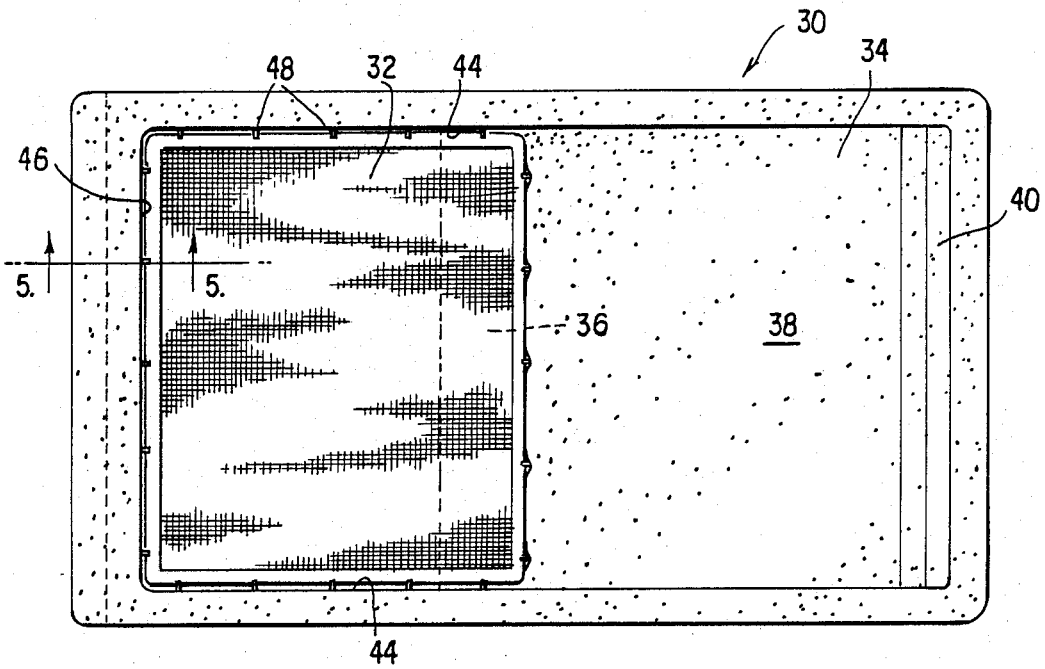
FIG. 4 is a plan view of the pool of FIG. 3.

The landing or splash pool of the present invention, shown in FIGS. 3 and 4 and designated generally by the reference numeral 30, retains the safety features of the conventional splash pool for children while providing greater protection for adult users. The pool 30 includes an entry zone 32 located adjacent to the exit end of the flume section 18 of the water slide and, at the opposite end of the pool, an exit zone 34. The entry zone is substantially deeper than that of the conventional pool, having a water depth typically of 6 to 7 feet. The length of the entry zone is sufficient to insure that any rider exiting from the slide into the pool will enter the water well short of the up slope 36 of the entry zone. A minimum length of 10 feet is typical for slow speed exit flumes, lengths of 50 feet are typical with speed slides. The width of the pool is determined by the number of flumes exiting into the splash pool installation. The exit zone, as with the conventional splash pool, has a bottom wall 38 which slopes upwardly gradually to exit steps 40. Typically, the maximum water depth of the exit zone does not exceed 3½feet.

The entry zone of the splash pool is provided with a false floor 42 located at a water depth of 3 to 3½ feet, corresponding to the bottom wall 38 of the exit zone 34. Preferably, the false floor is a Nylon net of relatively close mesh which is attached to the entry zone side walls 44, up slope wall 36 and near wall 46 by connectors 48 mounted at spaced intervals along the pool walls. These connectors are preferably recessed into the pool walls and may include turnbuckles or other adjustment means to permit adjustment of the tension of the net and, preferably, are readily detachable to allow removal of the net for cleaning, repair or replacement when desired.

Figure 5:
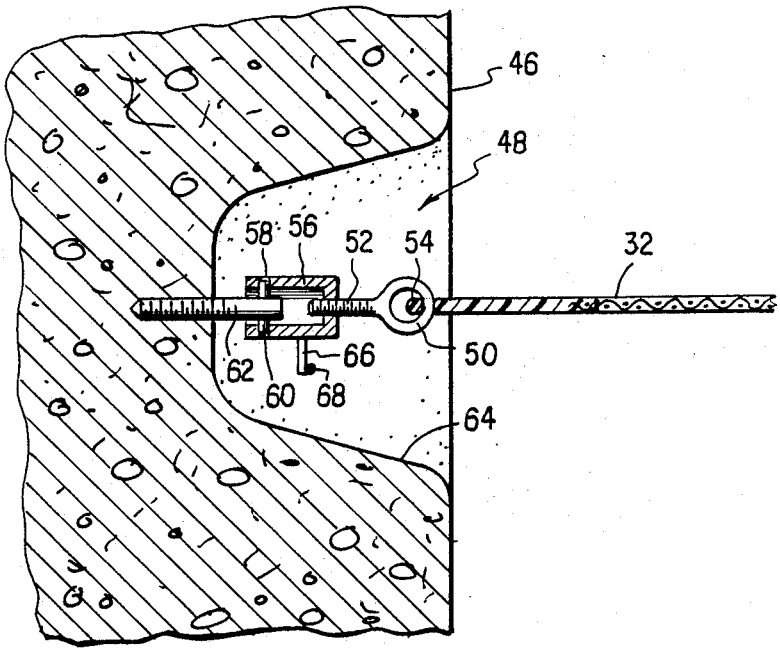
FIG. 5 is a fragmentary cross sectional view taken on the line 5—5 of FIG. 4.

One type of connector 48 is shown in FIG. 5. It will be understood, however, that a wide variety of connectors may be used. The illustrated connector includes an eyebolt 50 having a threaded shank 52, the eye of the bolt 50 receiving the cord 54 which forms the edge of the net 32. Threaded onto the bolt shank 52 is a sleeve 56 which is open at its opposite end and provided with diametric J-shaped slots 58 for engaging a crosspin 60 carried at the end of a stud 62 anchored in the pool wall 46, for example. The eyebolt and sleeve function as a turnbuckle to permit adjustment of the tension on the net. The bayonet type connection between the sleeve and the stud allows for the rapid release of the net when desired. Preferably, the connector assembly 48 is located in a recess 64 in the pool wall so that accidental contact with the assembly is eliminated. Provision may be made for remotely releasing the connectors. For example, each sleeve 56 may include a downwardly projecting lever 66 connected at its lower end to a control line 68 extending to a location remote of the pool. When the line is pulled, the sleeve is rotated to release the bayonet connection. If the same control line is attached to all of the connector assemblies, the net may be disconnected and removed rapidly. While recessed connectors are preferred, other connectors may be employed. In such installations, the connectors should be of such configuration and materials as to avoid injury to a person's skin in the event of contact with a connector. Alternatively, the connectors may be shielded from contact.

The use of a mesh net as the false floor is desirable as a net offers low hydrodynamic drag and local mass when impacted and, thus, does not offer high inertial resistance to impact. This is of importance when an adult strikes the net, for example, as a result of improper use of the water slide. The ability of the net to deform rapidly at the region of impact together with the elasticity of the net serve to safely decelerate the adult, the depth of water below the net providing a safety zone for this. A relatively close mesh is used to eliminate the risk of a child's foot passing through the net. Such a close mesh net provides a safe and comfortable walking surface for both children and adults, permitting an easy exit from the splash pool. While the net may be constructed of a variety of different materials, Nylon is preferred as it is readily available and is easily installed on-site, possesses adequate strength and elasticity, and does not support the growth of algae or fungus which would tend to make the net surface unduly slippery. Additionally, a Nylon net is light weight and thus easily removed from the pool for cleaning of either the net or the pool and is impervious to pool sanitation chemicals and exposure to sunlight.

While a preferred embodiment of the invention has been illustrated and described in detail herein, it will be understood that changes and additions may be had therein and thereto without departing from the spirit of the invention. Reference should, accordingly, be had to the appended claims in determining the true scope of the invention.

I claim:

1. A recreational water slide splash pool for a water slide comprising:

an entry zone located adjacent the exit of the water slide having a water depth of approximately six to seven feet; said entry zone extending from said slide exit a distance sufficient to decelerate a slide rider entering said zone from the slide exit;

an exit zone leading from the side of said entry zone opposite the water slide, said exit zone being shallow; and a net forming a false floor in said entry zone and co-extensive therewith at approximately one half the water depth thereof, said net being attached to the walls of said entry zone, said net being formed of a resilient material capable of deformation upon impact.

2. The recreational water slide splash pool of claim 1 wherein said false floor is a close mesh net.

3. The recreational water slide splash pool of claim 2 wherein said false floor is a close mesh Nylon net.

4. The recreational water slide splash pool of claim 3 wherein said net is attached to said walls by adjustable connectors whereby the tension of said net may be adjusted.

5. In a recreational water slide installation having a water slide in the form of a chute extending from an elevated entry downwardly to an exit and a splash pool adjacent the exit for receiving and decelerating a slide rider, the improvement in said splash pool which comprises:

an entry zone of said splash pool of substantially greater depth than that of a conventional splash pool; said entry zone extending from said slide exit a distance sufficient to decelerate a slide rider entering said zone from the slide exit and a close mesh net forming a false floor in said entry zone at approximately one half the depth of said entry zone, and co-extensive therewith said net being attached to the walls of said entry zone, said net being formed of a resilient material capable of deformation upon impact.

6. The improvement of claim 5 wherein said net is attached to said walls by adjustable connectors whereby the tension of said net may be adjusted.

7. The improvement of claim 5 wherein said net is a Nylon mesh net.

8. The improvement of claim 6 wherein said connectors are recessed into said walls.

9. The improvement of claim 6 further including means for releasing said connectors from a location remote from said splash pool.

* * * * *